US005881504A

United States Patent [19]

Wakisaka et al.

[11] Patent Number: 5,881,504

[45] Date of Patent: Mar. 16, 1999

[54] TEMPORARY FRAME SYSTEM FOR CONSTRUCTION

[75] Inventors: Tatsuya Wakisaka, Tokyo; Kyoichi Hishikawa, Saitama; Noriyuki Furuya, Tokyo; Kyoji Yoshino, Tokyo; Hiroaki Ikeda, Tokyo; Hideo Ono, Saitama; Kohei Kurita, Chiba; Toshimitsu Sakai, Saitama, all of Japan

[73] Assignee: Obayashi Corporation, Osaka, Japan

[21] Appl. No.: 765,967

[22] PCT Filed: Dec. 28, 1995

[86] PCT No.: PCT/JP95/02761

§ 371 Date: Mar. 26, 1997

§ 102(e) Date: Mar. 26, 1997

[87] PCT Pub. No.: WO96/36780

PCT Pub. Date: Nov. 21, 1996

[30] Foreign Application Priority Data

| | | | |
|---|---|---|---|
| May 15, 1995 | [JP] | Japan | 7-116124 |
| May 15, 1995 | [JP] | Japan | 7-116125 |
| Sep. 11, 1995 | [JP] | Japan | 7-232823 |

[51] Int. Cl.[6] ..... E02D 35/00; E04G 21/14; E04H 12/34

[52] U.S. Cl. ..... 52/125.2; 52/125.6; 52/123.1; 52/749; 52/653.1; 52/651.01; 52/651.05

[58] Field of Search ..... 52/125.2, 125.6, 52/123.1, 749, 653.1, 651.01, 651.05

[56] References Cited

U.S. PATENT DOCUMENTS

| | | | |
|---|---|---|---|
| 3,748,805 | 7/1973 | Boros | 52/125.2 X |
| 3,921,362 | 11/1975 | Cortina | 52/125.6 X |
| 4,197,689 | 4/1980 | DeMuth | 52/123.1 X |
| 5,417,018 | 5/1995 | Matsumoto et al. | 52/123.1 |

FOREIGN PATENT DOCUMENTS

| | | | |
|---|---|---|---|
| 377512 | 7/1932 | United Kingdom | 52/125.2 |

*Primary Examiner*—Christopher Kent
*Assistant Examiner*—W. Glenn Edwards
*Attorney, Agent, or Firm*—Wenderoth, Lind & Ponack, L.L.P.

[57] ABSTRACT

A temporary frame system includes four masts arranged outside of a building to be constructed. The frame system includes a climbing mechanism mounted on each mast for upward and downward movement thereon, a canopy frame fixed at four corners by respective climbing mechanisms and horizontally covering the entire upper surface of the building, a plurality of overhead traveling cranes arranged on the lower surface of the canopy frame, and a jib crane movable along a guide rail provided on an upper surface of the canopy frame. The overhead traveling crane includes a main rail positioned on a lower surface of the canopy frame and subsidiary rails arranged on both sides of the main rail in parallel thereto. A transporting girder is movably supported on the main rail and subsidiary girders are movably supported on the subsidiary rails. A plurality of hoists are provided on the overhead traveling crane. The transporting girder is a dual type which has two, first and second girders.

14 Claims, 5 Drawing Sheets

TEMPORARY FRAME SYSTEM FOR CONSTRUCTION

BACKGROUND OF THE INVENTION

1. Field of the Invention

The present invention relates to a all-weather type temporary frame system for construction which permits constructional work to be performed even under bad weather conditions.

2. Background Art

There has been proposed an all-weather type temporary frame as a temporary foothold for construction of a high-rise building of RC construction. The temporary frame includes a plurality of temporary support frames vertically provided around a planned building to be constructed, and a canopy frame supported at the upper portion between respective temporary support frames and having a shape sufficient for covering entire upper surface of the planned building. According to increasing the height of the constructed building, the temporary support frames are added upwardly to elevate the canopy frame so that constructional work can be performed without being affected by the weather.

On the other hand, an overhead travelling crane is arranged on the lower surface of the canopy frame. Building materials lifted by lifting equipment, such as a cargo lift, a man/cargo elevator or so forth are transported to various portions by the overhead traveling crane for performing assembling work.

The overhead traveling crane includes a main girder reciprocally movable along a main rail, a subsidiary girder reciprocally movable along a subsidiary rail arranged at the side of the main rail in parallel to the latter, and a hoist movable along the main girder and the subsidiary girder for transit between respective girders at the condition where both girders are matched in alignment. Generally, two hoists are provided in the overhead traveling crane. At a condition where one of the hoists is moved on the main girder, the building material is lifted into the intended floor for execution by the lifting equipment. At this condition, the main girder is moved along the main rail to transfer the hoist to one of the subsidiary girders which is placed in alignment with the main rail. The subsidiary girder, to which the hoist is transferred from the main rail, is moved along the subsidiary rail for transporting the building material to the destinated position.

Meanwhile, in the temporary frame system, in order to constantly arrange the canopy frame immediately above the floor for executing the constructional work, it becomes necessary to sequentially rise depending upon progress of the constructional work. Conventionally, in Japanese Unexamined Patent Publication (Kokai) No. Heisei 4-221172, for example, discloses a method of lifting the temporary support frames by a lifting means, arranged around the temporary support frame (temporary tower) on the ground, to add new supporting material at the lower side.

On the other hand, in Japanese Unexamined Patent Publication No. Heisei 5-59817, for example, there has been proposed a method, in which the temporary support frame is constructed with a plurality of telescopic long posts each of which is expandable. Also, a work station is arranged at the upper portion of the long posts, and by expanding the long posts sequentially, the work station is elevated.

However, the former invention increased weight of the added temporary supporting materials is increased in accordance with the rising temporary frame. Accordingly, load on the lifting means is sequentially increased. The lifting means requires a large driving force to be preliminarily set with taking the final weight to be lifted into account.

On the other hand, the latter invention requires a large driving force since overall load is exerted on the long posts from initiation of lifting. Furthermore, extracting length of the long post is increased at every occasion of expansion of the post to cause instability of supporting moment at joint portions of the post.

Furthermore, in either invention, since the temporary support itself is moved and support therefore cannot be provided by the building under construction, and self-standing of the individual support frame can become more unstable with taller buildings. In order to solve the problem of instability of self-standing supports, it is considered to provide reinforcement members between the temporary support frames as braces. However, installation of braces is not only cumbersome but also causes further increase of the load to require greater power for lifting.

Thus, the conventional all-weather type temporary frame was inappropriate as the temporary frame for constructing a building having large number of floors, such as skyscraper or so forth.

Furthermore, in the hoist provided in the conventional overhead traveling crane, since only one main girder is provided, even when the building material is lifted by the lifting equipment, the lifting equipment is inherently tied up until the empty hoist which completed former transportation operation, is transferred to the main girder and reaches the lifting equipment, and lifts the building material. Accordingly, efficiency of the transporting operation of the building material is lowered to cause extension of the construction work.

The first object of the present invention is to make it possible to effectively use the existing system, to require a driving force for elevating the canopy frame which is small and always constant, to provide support for the temporary support frames from the building, to restrict deflection upon elevation of the canopy frame, and to permit execution of addition of the temporary support frame at the highest position without interfering with construction work.

The second object of the present invention is to make transfer of the building materials quicker by providing a double type main girder and by maintaining at least one of the main girders empty, and thus improve efficiency of transportation.

SUMMARY OF THE INVENTION

In order to accomplish the above objects, the present invention comprises:

one or more temporary support frames vertically provided in the vicinity of or within intended construction site of a building and to be added sequentially to an upper side depending upon increasing of a height of construction;

a climbing mechanism fitted on the periphery of the temporary frame via upper and lower guide rollers and being arranged a jerk for up and down motion; and a canopy frame supported between upper and lower guide rollers of the climbing mechanism and covering the entire upper surface of the building.

On the other hand, the present invention also comprises:

one or more temporary support frames vertically provided in the vicinity of or within an intended construction site of a building and to be sequentially added to an upper side depending upon increasing of a height of construction;

a climbing mechanism fitted on the periphery of the temporary frame via upper and lower guide rollers and being arranged a jerk for up and down motion; and a canopy frame supported below the climbing mechanism and covering an entire upper surface of the building.

In the inventions set forth above, the temporary support frame may be a mast of a tower crane. The temporary support frame may be supported on the building via a horizontal stay. It is also preferred to arrange an overhead crane on a surface of the canopy frame.

The present invention is characterized in that the overhead traveling crane includes a main girder reciprocally movable along a main rail and a subsidiary girder reciprocally movable along a subsidiary rail arranged at a side portion of the main rail in parallel to the latter, and a hoist which is movable along the main girder and the subsidiary girder and can be transferred between respective girders in a condition where both girders are aligned with each other, and a building material being transferred to the hoist positioned in the main girder. The main girders are constructed as a dual type to include two girders arranged along an extending direction of the main rail.

In the present invention, the dual type main girder may be integrally movable. It is preferred that a stationary girder for transferring is arranged between the main rail and the subsidiary rail and to be placed in alignment with respective of crane girders, and a transporting object is transported to a destinated transporting position via respective crane girders and the stationary girder.

BRIEF DESCRIPTION OF THE DRAWINGS

FIG. 3(*b*) is a sectional view taken along line B—B, and

FIG. 3(*c*) is a sectional view taken along line C—C;

DETAILED DESCRIPTION OF THE INVENTION

Figure 1:
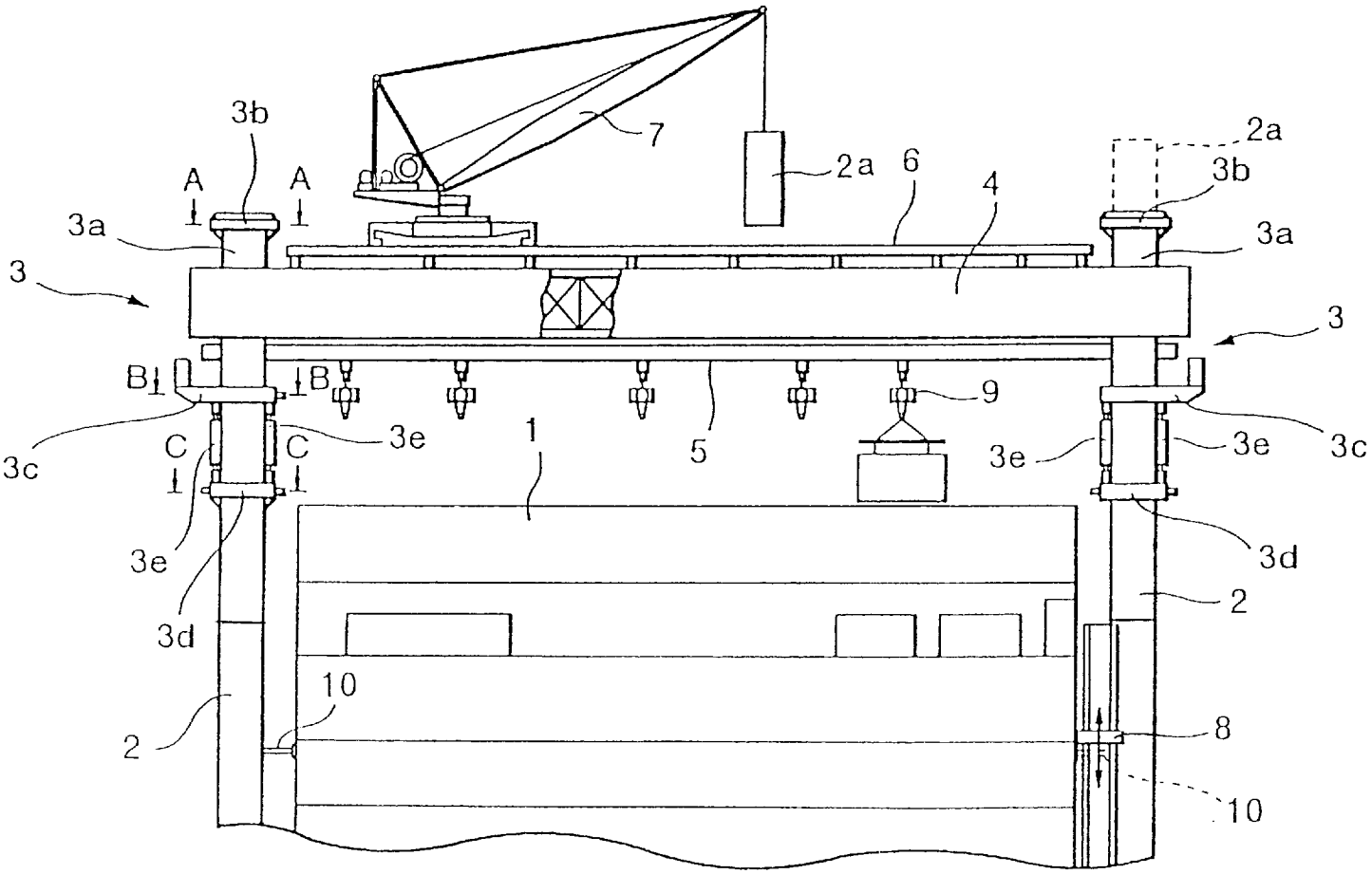
FIG. 1 is a side elevation of one embodiment of a temporary frame system according to the present invention.
Figure 2:
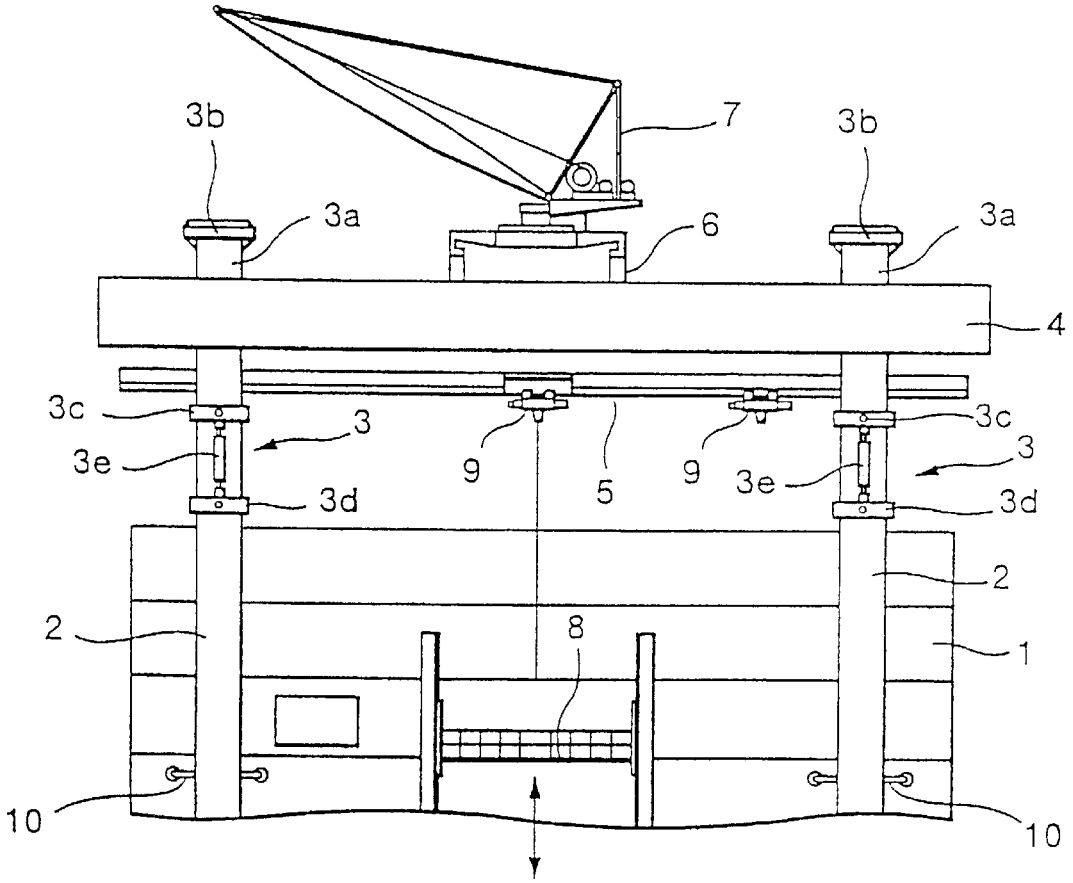
FIG. 2 is a front elevational view of the temporary frame system shown in FIG. 1.

In FIGS. 1 and 2, a temporary frame system is arranged outside of a building 1 under construction. The frame system comprises four masts (only two are shown in the drawing) vertically extended from a foundation arranged on the ground, climbing mechanisms 3 mounted on respective masts for up and down movement, a canopy frame 4 fixed to respective climbing mechanisms at four corners and horizontally covering an overall upper surface of the building 1, an overhead traveling crane 5 arranged on the lower surface of the canopy frame, and a jib crane 7 arranged for movement along a guide rail 6 provided on the upper surface of the canopy frame 4 (the guide rail 6 is arranged at the center of the canopy frame 4, for example).

On the other hand, at the center of one side surface of the building 1, lifting device or equipment 8, such as a cargo lift, man/cargo elevator or so forth (hereinafter simply referred to as lifting equipment) is arranged. Building materials, such as precasted members or so forth, lifted by the lifting equipment 8 are transferred to a hoist 9 traveling along the overhead traveling crane 5 and thus supplied to respective portions of the building 1.

Existing mechanisms to be, employed in a tower crane, are applied as the masts 2 and the climbing mechanisms 3. The mast 2 can be selected not only to be a truss built-up column shaped configuration but also to be other cylindrical column shaped configuration, and, as shown in FIG. 2, the height thereof can be increased by adding a mast section or member 2*a* lifted by the jib crane 7 according to elevation of the working floor while maintaining self-standing stability by support provided by horizontal stays 10 which are each appropriately fixed to the building 1 at one end.

The climbing mechanism 3 includes a guide sleeve 3*a* fitted on the outer periphery of the mast 2, an upper frame 3*b* integrated with the guide sleeve 3*a* and surrounding the periphery of the mast 2, and an intermediate frame 3*c*. The corner of the canopy frame 4 is fixed by clamping between the lower surface of the guide sleeve 3*a* and the upper surface of the intermediate frame 3*c*. On the other hand, at the lower portion of the intermediate frame 3*c*, a lower frame 3*d* which similarly surrounds the mast 2 is arranged. The frames 3*c* and 3*d* are connected by a plurality of lifting hydraulic jacks 3*e*.

Figure 3A:
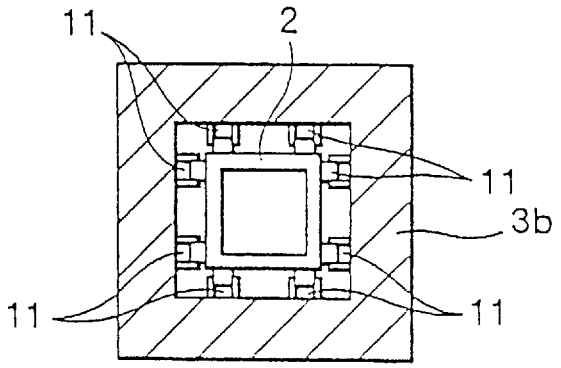
FIG. 3(*a*) is a sectional view taken along line A—A of FIG. 1.
Figure 3B:
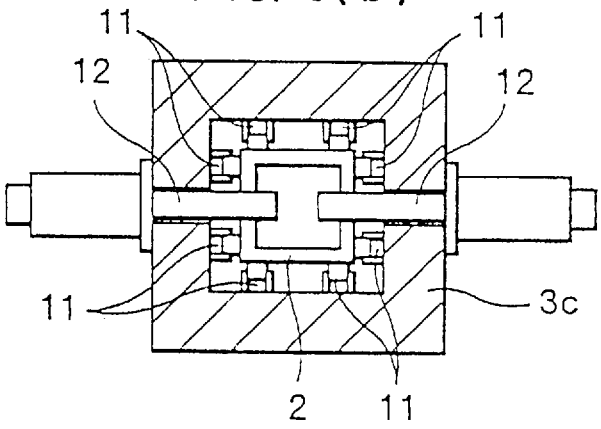
Figure 3C:
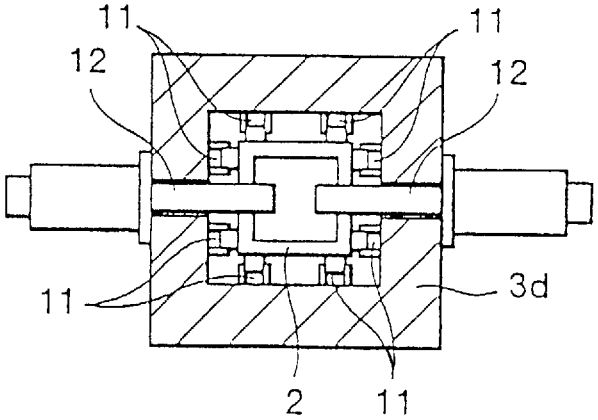

At the inside of respective frames 3*b*, 3*c* and 3*d*, a plurality of guide rollers 11 in contact with an outer side portion of the mast 2 to rotate for guiding respective frames 3*b* and 3*c* for up and down movement. On the other hand, on the intermediate frame 3*c* and the lower frame 3*d*, a pair of pins 12 for bearing vertical load are releasably inserted into the mast 2 for fixedly supporting the climbing mechanism 3 on the periphery of the mast 2, as shown in FIGS. 3(*b*) and (*c*).

In the construction set forth above, at the resting condition of the climbing mechanism 3, a hydraulic jack 3*e* is contracted and the climbing mechanism 3 is supported at the predetermined position on the mast 2 by respective pins 12.

For elevating, the pins 12 of the intermediate frame are released and the hydraulic jack 3*e* is expanded. Then, the portion located higher than the intermediate frame is elevated at a magnitude corresponding to the jack stroke. Subsequently, after supporting on the mast 2 in the vertical direction by inserting the pins 12 into the intermediate frame 3*c*, the pins 12 engaging with the lower frame 3*d* are released and the hydraulic jacks 3*e* are contracted. Thus, the lower frame 3*d* is also elevated. Thereafter, by inserting the pin 12, the lower frame 3*d* is supported on the mast 2 in the vertical direction, and then, the elevating operation is completed.

Thus, since the masts are sequentially added upwardly, the existing masts 2 are fixed in place. Therefore, support for the mast 2 can be provided by the building by means of the horizontal stays 10. On the other hand, since the climbing mechanisms 3 are elevated while bearing only the weight of the canopy frame 4 during the elevating operation, the driving force for elevating the canopy frame 4 can be made smaller and is always constant. Furthermore, since the mast is provided with self-standing stability by the horizontal stays, it becomes possible to reduce or eliminate the braces for connecting between the masts 2 to achieve an effect of reduction of weight.

The foregoing elevation of the canopy frame 4 by means of the climbing mechanisms 3 is performed in the step not requiring transporting operation of the building materials and by simultaneously operating four climbing mechanisms 3 for elevating operation.

At this time, a force to cause distortion of the canopy frame 4 is generated due to excessively small elevation speed at each respective portion. However, since the canopy mechanism 4 is clamped between the sleeves 3*a* and the guide rollers 11 of the upper frame 3*b* and the intermediate frame 3*c* act as reaction rollers in the opposite direction to the tilting direction of the canopy frame, and also since the distance between the guide rollers 11 located at upper and lower positions becomes longer, distortion of the canopy mechanism 4 can be successfully restricted. The force to cause distortion of the canopy frame is also caused when the overhead traveling crane 5 transports the building materials. However, since the guide rollers 11 act as reaction rollers, distortion of the canopy frame can be restricted.

After elevation, by exerting the load on the masts 2, the four corners of the canopy frame 4 can be positioned at the height of the masts 2. Thereafter, transporting operation of the building materials can be resumed.

As set forth, infeeding of the materials necessary for construction and installation are performed by the overhead traveling crane. Therefore, the jib crane 7 exclusively performs lifting of the masts 2 and sequentially adding the mast upwardly. Thus, installation of more masts and the construction work do not interfere with each other.

After completion of construction of the building, the canopy frame 4 is disassembled except for the frame portion extending between the overhead traveling crane 5 and the climbing mechanisms 3, and disassembled components are taken out via the jib crane 7 left on a rooftop of the building 1 so as not to interfere with the building 1. Thereafter, by reverse climbing the climbing mechanism 3, the frame portions extended therebetween are lowered. At this time, the masts 2 are taken out in order from the upper portion by the jib crane. Finally, the jib crane is disassembled and taken out with a relatively small crane. Then, the small crane is lowered by the elevator or so forth of the building 1. Thus, the overall temporary frame system can be removed.

It should be noted that while discussion is given in the case where the masts 2 are arranged at four positions outside of the building 1 since the building 1 is of rectangular cross section in the foregoing embodiment, it is possible to arrange one to three masts depending upon the area of the floor of the building, and the canopy frame is covered at the upper portion. When the area of the floor is large, a greater number of masts can be provided as a matter of course.

Figure 4:
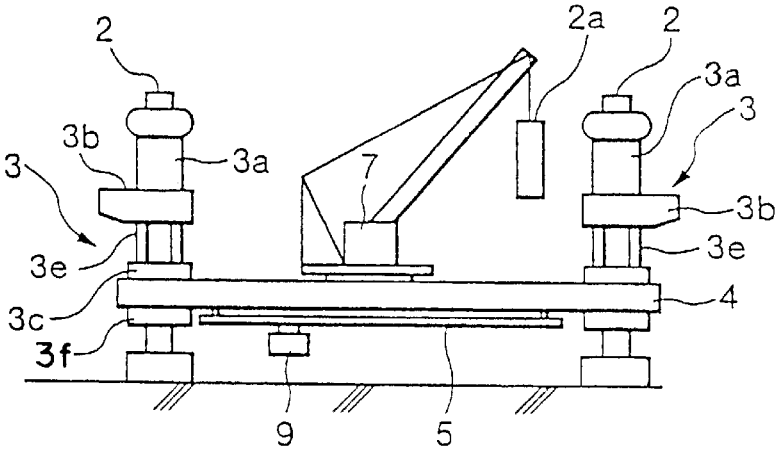
FIG. 4 is a side elevational view showing another embodiment of the temporary frame system according to the present invention, which is shown in the initially assembled state.

Next, with reference to FIGS. 4 and 5, other aspects will be discussed.

In this aspect, the canopy frame 4 is supported, in the condition in which it is hanged at four corners at a lower portion of the climbing mechanisms 3. In particular, the climbing mechanism 3 includes the guide sleeve 3*a* fitted on the outer periphery of the mast 2, the upper frame 3*b* integrated at the lower portion of the guide sleeve 3*a*, the lower frame 3*c* arranged at the lower portion of the upper frame 3*b*, and a plurality of the elevating hydraulic jacks 3*e* connected between the upper and lower frames 3*b* and 3*c*. On the lower surface side of the lower frame 3*c*, the canopy frame 4 is supported in the hanging condition by extending the masts 2 therethrough. At the lower surface side of the canopy frame 4, a support frame 3*f* is fixed on the outer periphery of the mast 2. As the jib crane 7, a fixed type crane is employed. It should be noted that illustrated by respective section lines of A—A, B—B and C—C of FIG. 5 correspond to the respective illustrations shown in FIGS. 3(*a*), 3(*b*) and 3(*c*).

Figure 5:
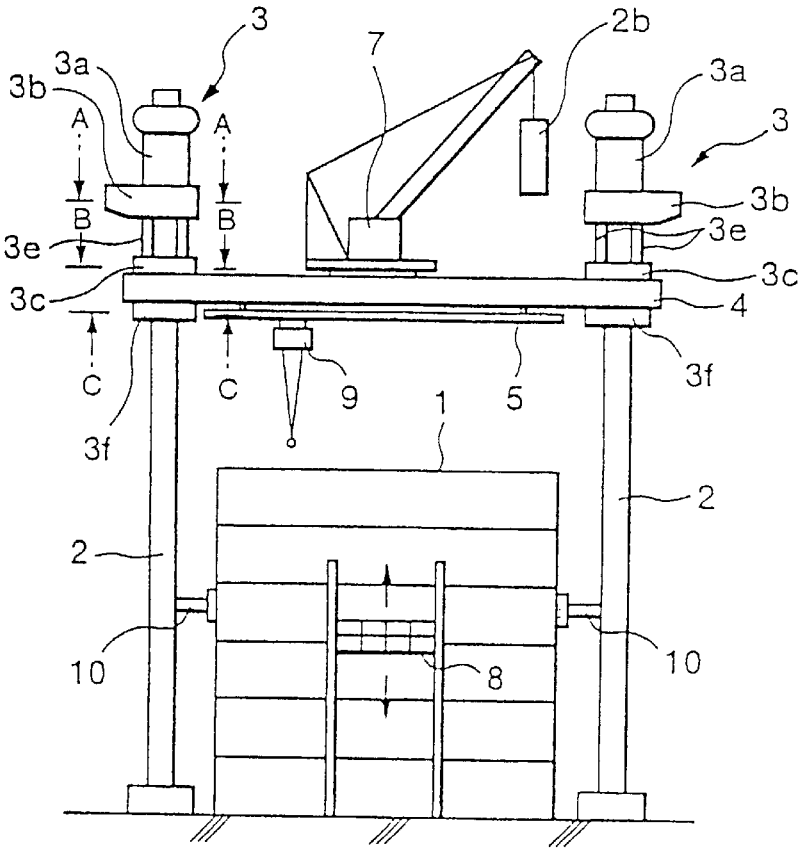
FIG. 5 is a side elevational view of the system under construction.

Therefore, assembling of the canopy frame 4 and installation of the jib frame 7, as shown in FIG. 5, can be performed right above the foundation of the masts 2. Therefore, working height from the ground is low and work efficiency and security becomes high. After assembling the climbing mechanisms 3 to upper portions of the four corners, these climbing mechanisms 3 are driven to elevate. Thereafter, the overhead traveling crane 5, the hoist 9 and so forth are assembled to complete assembling operation. Subsequently, with elevating the canopy frame 4, construction work of the building 1 is performed.

Thus, assembling of the canopy frame 4 can be performed near the ground or in the elevated condition. Thus, workability in assembling is high and high accuracy can be obtained. Also, since ground level of the canopy frame 4 upon assembling can be made lower, work can be done safely.

Figure 6:
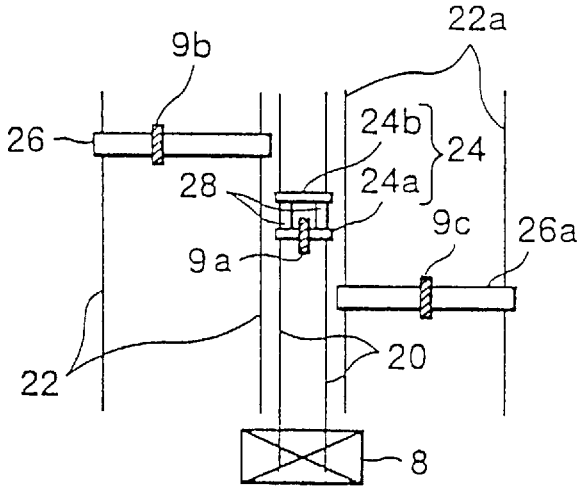
FIG. 6 is a schematic plan view for explaining operation of an overhead traveling crane according to the present invention.

The overhead traveling crane 5 employed in two embodiments are in the form illustrated in FIGS. 6.

The overhead traveling crane 5 includes a main rail 20 positioned at the center portion of the lower surface of the canopy frame 4 corresponding to the lifting equipment 8, and subsidiary rails 22 and 22*a* are located at both sides of the main rail 20 and in parallel to the main rail 20. On the main rail 20, a transporting girder 24 as a main girder is movably supported. On the subsidiary rails 22 and 22*a*, building-up girders 26 and 26*a* as subsidiary girders are movably supported.

In the illustrated embodiment, first, second and third hoists 9*a*, 9*b* and 9*c* are provided on the overhead traveling crane 5. The first hoist 9*a* is positioned on the transporting guarder 24. Also, the second and third hoists 9*b* and 9*c* are positioned on the building-up girders 26 and 26*a*, respectively.

Here, in the illustrated embodiment, the transporting girder 24 is constructed as a dual type arranged in parallel and extending in the direction of the main rail 20 (in the drawings, dual main girders are integrated), and first and second girders 24*a* and 24*b* are provided. The first and second girders 24*a* and 24*b* are mutually connected via connecting portions 28, 28 to be integrated for movement along the main rail 20.

At least one of the first and second girders 24*a* and 24*b* forming the dual type girder, and an empty one of respective hoists 9*a*, 9*b* and 9*c* is positioned to constantly be in a position for receiving the material lifted by the lifting equipment.

Accordingly, a transition type hoist provided on the illustrated embodiment of the overhead traveling crane includes the transporting girder 24 along with the first and second girders 24*a* and 24*b*. Therefore, at least one of the first and second girders 24*a* and 24*b* can be empty, so that the hoist is not moved thereto. Therefore, the material lifted by the lifting equipment 8 is received by the hoist positioned on one of the first and second girders 24*a* and 24*b* to move into the main rail 20. Even in the case of transfer to one of the building-up girders 26 and 26*a*, and even if the hoists are positioned on these building-up girders 26 and 26*a*, the load carrying hoist on the first or second girder 24*a* or 24*b* can be transferred to the building-up girder 26 or 26*a* after moving the hoist of the building-up girder 26 or 26*a* to the empty side of the first and second girders 24*a* and 24*b*. Then, after moving, the hoisted load is transferred to the building-up girder 26 or 26*a*, and one of the first and second girders 24*a* and 24*b* together with the empty hoist is moved toward the lifting equipment 8 so that the material lifted by the lifting equipment 8 can be instantly loaded on the empty hoist.

Hereinafter, an example of basic control of the illustrated embodiment of the transporting method will be discussed. Namely, the overhead traveling crane 5 is provided with first, second and third hoists 9*a*, 9*b* and 9*c*. During operation of the second and third hoists 9*b* and 9*c*, positioned on the building-up girders 26 and 26*a*, the lifting equipment 8 lifts up material to the first hoist 9*a* positioned on the first girder 24*a* of the transporting girder.

Next, among the second and third hoists 9*b* and 9*c*, assuming that the second hoists completes operation and can perform the next operation, the transporting girder 24 is moved so as to arrange the second girder 24*b* in alignment with one of the building-up girders 26. Then, the second hoist 9*b* positioned on the building-up girder 26 is transferred to the second girder 24*b*. Next, the first girder 24*a*, on which the first hoist 9*a* hoisting the load is placed in matching with the building-up girder 26 to transfer the first hoist 9*a* to the building-up girder 26. At this condition, the first hoist 9*a* is moved along the building-up girder 26, and in conjunction therewith, the building-up girder 26 is moved along the subsidiary rail 22 to move the hoist 9*a* at arbitrary position within a left half region in the drawing relative to the main rail 20 to unload thereon.

Accordingly, at such condition, on the transporting girder 24, the empty second hoist 9*b* is positioned so that the next material lifted by the lifting equipment 8 can be hanged on the second hoist 9*b*, immediately. It should be noted, it is the matter of course to transfer the first hoist 9*a* to the other building-up girder 26*a*. Also, even by positioning the load hoisting first hoist 9*a* on the second girder 24*b* of the transporting girder 24, and in conjunction therewith, by transferring the second or third hoist 9*b* or 9*c* which becomes empty, of the building-up girder 26 or 26*a* to the first girder 24*a*, exchange of the first hoist 9*a* and second or third hoist 9*b* or 9*c* between the transporting girder 24 and the building-up girder 26 or 26*a* can be performed smoothly.

Thus, even when the hoists are positioned on the building-up girders 26 and 26*a* reciprocally moving along the subsidiary rail 22 and 22*a*, it becomes possible to position the hoist on at least one of the dual type main girder 24. Therefore, when the material is lifted by the lifting equipment, it becomes possible to receive the material by the hoist positioned at one side of the dual type main girder 24 without waiting for completion of work in the hoist positioned on the building-up girders 26 and 26*a*. Then, when the hoist 9 in load hoisting condition is transferred from the transporting girder 24 in the condition receiving the material to the building-up girder 26 or 26*a*, exchanging of the load hoisting hoist and the empty hoist can be smoothly performed by transferring the empty hoist 9 to the other of the transporting girder 24 from the building-up girders 26 and 26*a*, at first. Accordingly, reception of the material lifted by the lifting equipment 8 can be quickly performed to significantly improve material transporting efficiency.

It should be noted that the foregoing embodiments have been discussed for the case where the hoist is positioned on one of the first and second girders 24*a* and 24*b* which form the transporting girder. By such construction, only one driving source is required to significantly facilitate control in comparison with the case where two transporting girders are controlled independently to make the driving means simple and thus to contribute to the simplification of the overall system. However, the present invention should not be limited to the illustrated construction and can be constructed to position empty hoists on both of the first and second girders 24*a* and 24*b* and to return them to the lifting equipment 8 to hang the materials on the hoists 9.

On the other hand, the transporting girder is constructed by connecting the first and second girders 24*a* and 24*b* to move integrally with each other. However, it is possible to construct the transporting girder without integrating the first and second girders, and to enable respective girders to move independently by assembling the traveling control systems for respective girders to improve freedom of transportation depending upon building-up condition of the hoisted load of the hoist 9 positioned on the building-up girders 26 and 26*a* or lifting condition of the load by the lifting equipment 8.

Furthermore, while there is disclosed the system, in which the lifting equipment is provided at only one side (lower side in FIG. 6) of the transporting girder, the amount of the materials to be lifted should be large when the floor area of the building 1 is large. Therefore, it is desirable to provide the lifting equipment 8 at both sides (even in upper side in FIG. 6) of the transporting rail. In this case, the materials are lifted by two lifting equipments. However, since two girders are arranged in the transporting girder, the materials can be transported efficiently. Thus, as a whole, transporting efficiency of the materials contributes to shortening the necessary working period. Also, in this case, it is possible to provide two transporting rails and associating therewith four building-up rails, in total, and it is further possible to provide three or more transporting rails and to correspondingly increase the number of the building-up rails. Furthermore, it is not always required to provide the building-up rails at both sides of the transporting rail, but is possible to provide only one building-up rail for one transporting rail.

In addition, in a construction site, when a pillar is present at a predetermined position in the building, and as a result, both ends of respective crane girders cannot be matched in alignment due to interference with the pillar, it is possible to provide a stationary girder between the pillars at an orientation perpendicular to main rail 20 and the subsidiary rails 22 and 22*a* so that the transporting girder 24 and the building-up girders 26 and 26*a* are matched in alignment via the stationary girder for transferring the hoists. On the other hand, in such case, between the main rail 20 and the subsidiary rails 22 and 22*a* (in which the pillar is arranged), the hoist of the transporting girder 24 and the building-up girders 26 and 26*a* cannot be reached. Therefore, it becomes possible to transport the material in hanging condition to any position on the building 1 by providing a sliding girder which can be slidingly extracted in the same direction to the direction of extension of the girder, at the lower portion of the girders 24, 26 and 26*a*.

While the foregoing aspects are exemplary disclosed in the case where the building materials are transported, the present invention should not be specified to the foregoing embodiment, but can be applicable for transporting objects, such as waste material or products in a refuse disposal station, parts and/or products in general factories or so forth, for example, for transporting in hanging condition. When the present invention is applied for the refuse disposal station, the stationary girder may be arranged at a position shifted from the pillars vertically extended at appropriate positions of wide collection point, in other words, the pillars are arranged between the stationary girders.

We claim:

1. A temporary frame system comprising:

at least one temporary vertical support frame provided in the vicinity of or within an intended construction site, wherein a height of said vertical support frame can be increased by sequentially adding support frame sections depending upon the height of a construction project at the construction site;

a climbing mechanism fitted on a peripheral surface of said temporary support frame, said climbing mechanism including upper guide rollers engaging said peripheral surface of said temporary support frame, lower guide rollers engaging said peripheral surface of said temporary support frame, and at least one jack for effecting upward and downward movement of said climbing mechanism on said temporary support frame; and a canopy frame supported between said upper rollers and said lower rollers of said climbing mechanism.

2. The temporary frame system as claimed in claim 1, wherein said at least one temporary support frame is a mast of a tower crane.

3. The temporary frame system as claimed in claim 1, further comprising:

a main rail connected to said at least one temporary support frame;

a main girder movably supported on said main rail;

a first subsidiary rail positioned at a side of said main rail and extending in parallel to said main rail;

a first subsidiary girder movably supported on said first subsidiary rail; and a hoist movable along said main girder and first subsidiary girder so that said hoist can be transferred between said main girder and said first subsidiary girder when said girders are in alignment with each other, wherein said main girder is constructed as a dual type girder which includes two girders interconnected by connecting portions.

4. The temporary frame system as claimed in claim 3, wherein said dual type girder is movable along said main rail as a single unit.

5. The temporary frame system as claimed in claim 3, further comprising a stationary girder arranged between said main rail and maid subsidiary rail, wherein an object can be transported to a designated position via said main girder, said first subsidiary girder, and said stationary girder upon alignment of said main girder, said first subsidiary girder, and said stationary girder.

6. The temporary frame system as claimed in claim 1, wherein the construction project is a building and said at least one temporary vertical support frame comprises four temporary vertical support frames.

7. The temporary frame system as claimed in claim 1, further comprising at least one horizontal stay having a first end connected to said at least one vertical support frame and a second end for connecting to said construction project.

8. A temporary frame system comprising:

at least one temporary vertical support frame for being provided in the vicinity of or within an intended construction site, wherein a height of said vertical support frame can be increased by sequentially adding support frame sections depending upon the height of a construction project at the construction site;

a climbing mechanism fitted on a peripheral surface of said temporary support frame, said climbing mechanism including upper guide rollers engaging said peripheral surface of said temporary support frame, lower guide rollers engaging said peripheral surface of said temporary support frame, and at least one jack for effecting upward and downward movement of said climbing mechanism along said temporary support frame; and a canopy frame supported by said at least one temporary vertical support frame at a position below said climbing mechanism.

9. The temporary frame system as claimed in claim 8, wherein said at least one temporary support frame is a mast of a tower crane.

10. The temporary frame system as claimed in claim 8, further comprising:

a main rail connected to said at least one temporary support frame;

a main girder movably supported on said main rail;

a first subsidiary rail-positioned at a side of said main rail and extending in parallel to said main rail;

a first subsidiary girder movably supported on said first subsidiary rail; and a hoist movable along said main girder and subsidiary girder so that said hoist can be transferred between said main girder and said subsidiary girder when said girders are in alignment with each other, wherein said main girder is constructed as a dual type girder which includes two girders interconnected by connecting portions.

11. The temporary frame system as claimed in claim 10, wherein said dual type main girder is movable along said main rail as a single unit.

12. The temporary frame system as claimed in claim 10, further comprising a stationary girder arranged between said main rail and said subsidiary rail, wherein an object can be transported to a designated position via said main girder, said subsidiary girder, and said stationary girder upon alignment thereof.

13. The temporary frame system as claimed in claim 8, wherein the construction project is a building and said at least one temporary vertical support frame comprises four temporary vertical support frames.

14. The temporary frame system as claimed in claim 8, further comprising at least one horizontal stay having a first end connected to said at least one vertical support frame and a second end for connecting to said construction project.

* * * * *